US005216745A

United States Patent [19]

Shpiro

[11] Patent Number: 5,216,745

[45] Date of Patent: Jun. 1, 1993

[54] SOUND SYNTHESIZER EMPLOYING NOISE GENERATOR

[75] Inventor: Zeev Shpiro, New York, N.Y.

[73] Assignee: Digital Speech Technology, Inc., Palo Alto, Calif.

[21] Appl. No.: 420,899

[22] Filed: Oct. 13, 1989

[51] Int. Cl.[5] ..... G10L 9/04

[52] U.S. Cl. ..... 395/2

[58] Field of Search ..... 381/29-40, 381/51-53, 61; 364/513.5; 84/645, 653

[56] References Cited

U.S. PATENT DOCUMENTS

| | | | |
|---|---|---|---|
| 4,387,269 | 6/1983 | Hashimoto et al. | 381/51 |
| 4,389,537 | 6/1983 | Tsunoda et al. | 381/51 |
| 4,423,290 | 12/1983 | Yoshida et al. | 381/51 |
| 4,639,877 | 1/1987 | Raymond et al. | 364/513.5 |
| 4,703,680 | 11/1987 | Wachi et al. | 84/653 |
| 4,783,812 | 11/1988 | Kaneoka | 381/61 |
| 4,811,396 | 3/1989 | Yatsuzuka | 381/30 |
| 4,817,157 | 3/1989 | Gerson | 381/40 |
| 4,868,867 | 9/1989 | Davidson et al. | 381/35 |
| 4,908,867 | 3/1990 | Silverman | 381/51 |
| 4,933,980 | 6/1990 | Thompson | 381/61 |
| 4,963,034 | 10/1990 | Cuperman et al. | 381/30 |

*Primary Examiner*—Michael R. Fleming
*Assistant Examiner*—Michelle Doerrler
*Attorney, Agent, or Firm*—Fiddler Levine & Mandelbaum

[57] ABSTRACT

A sound synthesizer which may be associated with a personal computer and including apparatus for employing the output of a noise generator which is cataloged to provide a multiplicity of waveforms and apparatus for receiving the multiplicity of waveforms and creating therefrom desired sound signals, thus providing a synthesized sound output.

32 Claims, 5 Drawing Sheets

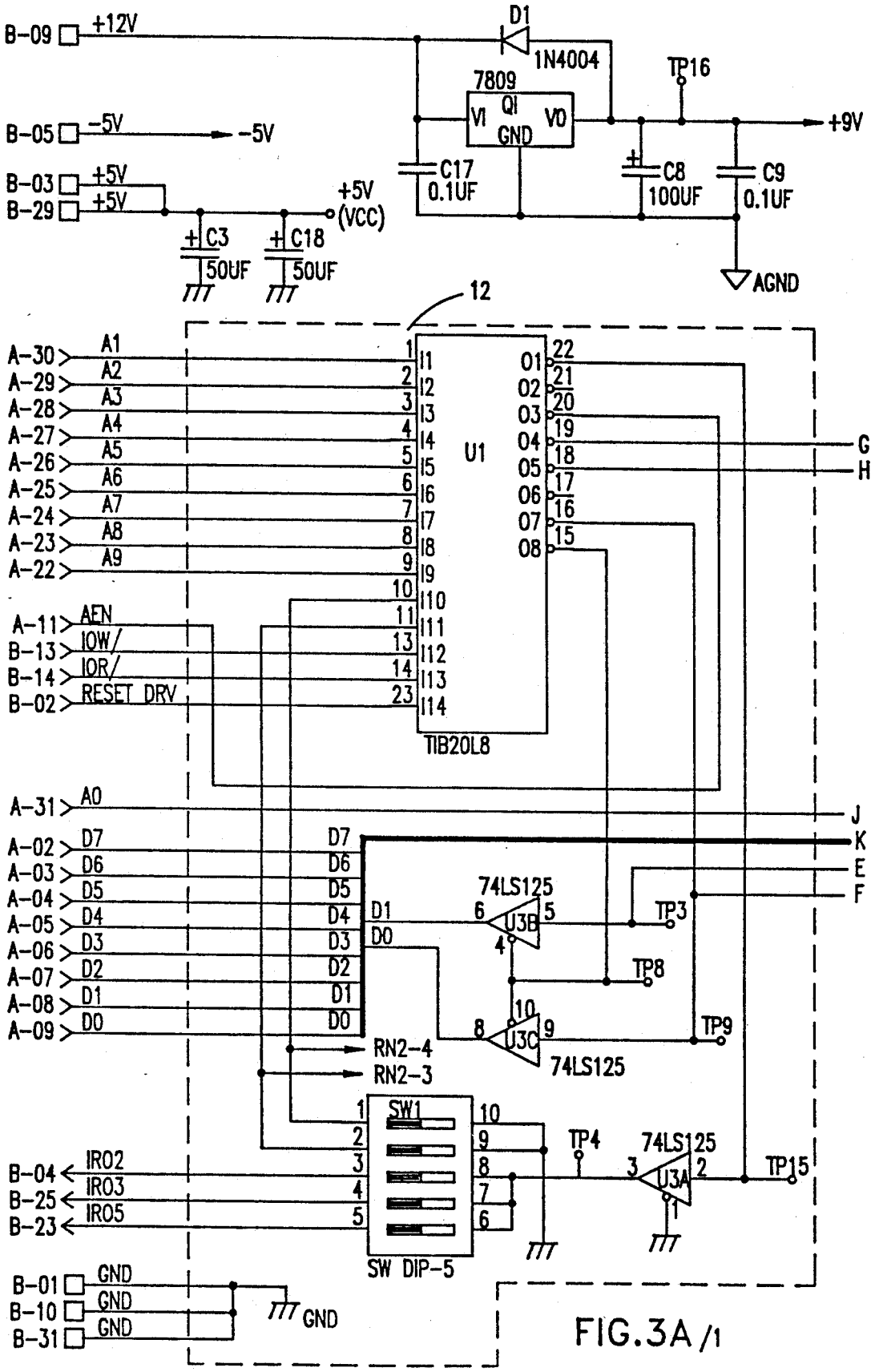
FIG.3A/1

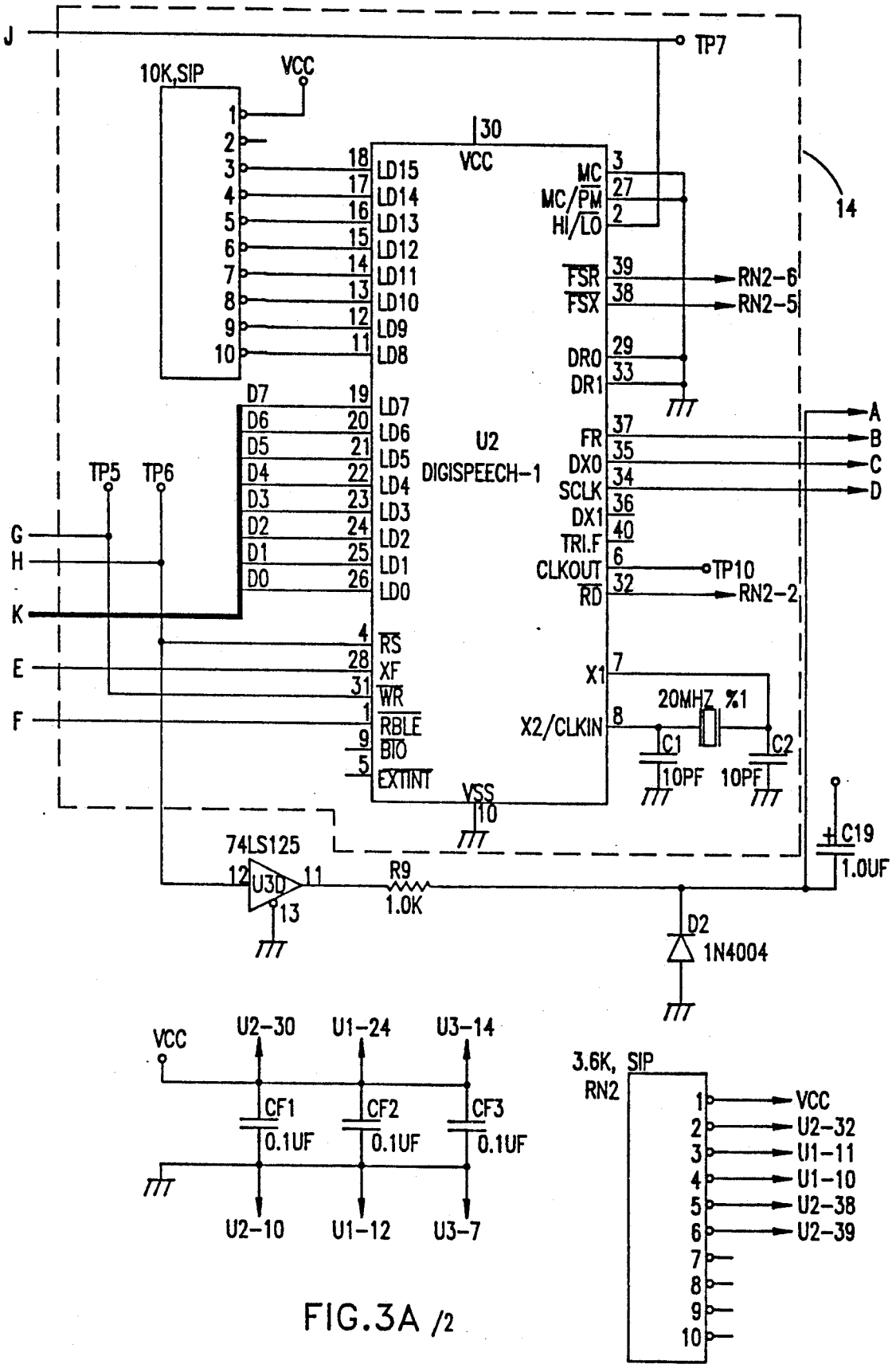
FIG.3A /2

SOUND SYNTHESIZER EMPLOYING NOISE GENERATOR

FIELD OF THE INVENTION

The present invention relates generally to sound synthesis.

BACKGROUND OF THE INVENTION

Speech synthesizers are well known in the art and are described in various U.S. Patents. References to speech synthesis include the following:

Three-chip System Synthesizes Human Speech, by Richard Wiggins and Larry Brantingham, Electronics, Aug. 31, 1978. This reference describes an early speech synthesizer employing linear predicitive coding (LPC) and using periodic impulses for voiced excitation and white noise for unvoiced excitation.

Design case history: Speak & Speel learns to talk, IEEE Spectrum, February, 1982, pp 45–49.

Products that talk, by Eric J. Lerner, IEEE Spectrum, July 1982, pp 32–37.

Realism in synthetic speech, by Gadi Kaplan and Eric J. Lerner, IEEE Spectrum, April, 1985, pp 32–37.

Code-Excited Linear Prediction (CELP): High Quality Speech at Very Low Bit Rates, by Manfred R. Schroeder and Bishnu S. Atal, ICASSP, 1985 IEEE, pp 25.1.1.–25.1.4. This reference illustrates the use of short and long delay predictors in voice transmission using codebook innovation sequences.

The most popular speech synthesizers, such as those manufactured and sold widely by Texas Instruments and described in the above article by Wiggins et al, employ a Linear Predictive Code (LPC) filter which operates on excitation functions which are either a series of pulses having varying spacing therebetween or white noise. Less popular speech synthesizers, such as those manufactured by Philips, employ a formant filter which operates on the same excitation functions as LPC synthesizers.

SUMMARY OF THE INVENTION

The present invention seeks to provide an improved speech synthesizer which operates at a relatively high data rate as compared with conventional LPC synthesizers, producing high quality sound reproduction from a compressed sound information source, at relatively low cost.

There is thus provided in accordance with a preferred embodiment of the present invention a sound synthesizer including apparatus for cataloging the output of a noise generator to provide a multiplicity of waveforms and apparatus receiving the multiplicity of waveforms for creating therefrom desired sound signals.

There is also provided in accordance with a preferred embodiment of the present invention a personal computer sound synthesizer including a codebook including a multiplicity of selectable waveforms, apparatus receiving the multiplicity of selectable waveforms for creating therefrom desired sound signals in response to index inputs, a memory, forming part of the personal computer, for storing the index inputs and a keyboard, forming part of the personal computer, for permitting operator control of the speech synthesis.

In accordance with one embodiment of the invention, the volume of the desired sound signals may be determined by an operator using the keyboard either before or during operation.

In accordance with a preferred embodiment of the present invention, the apparatus for cataloging comprises apparatus for selectably providing predetermined waveform outputs in response to predetermined index inputs.

Further in accordance with a preferred embodiment of the present invention, the apparatus for selectably providing comprises means for selectably providing a multiplicity of generally gaussian waveform outputs in response to said predetermined index inputs.

It is a particular feature of the present invention that in contrast to the prior art, which creates unvoiced speech signals directly from random white noise and voiced speech signals from a single train of pulses, the present invention employs cataloged signals, preferably, for example, in a generally gaussian configuration, which is effectively arranged so as to provide a readily accessible excitation vector codebook. Additionally in accordance with a preferred embodiment of the present invention, the apparatus receiving the multiplicity of selectable waveforms for creating therefrom desired sound signals includes a long delay prediction filter and a short delay prediction filter.

Further in accordance with a preferred embodiment of the invention, the apparatus receiving the multiplicity of selectable waveforms for creating therefrom desired sound signals also comprises variable gain means.

Additionally in accordance with a preferred embodiment of the invention, the long delay prediction filter is operative to emphasize periodic signal characteristics having a characteristic periodicity of at least 16 sound samples taken at an 8 KHz sampling rate.

Additionally in accordance with a preferred embodiment of the invention, the short delay prediction filter is operative to emphasize periodic signal characteristics having a characteristic periodicity of less than 12 sound samples taken at an 8 KHz sampling rate.

Further in accordance with a preferred embodiment of the invention, the long delay prediction filter is operative upstream of the short delay prediction filter.

Additionally in accordance with a preferred embodiment of the invention, the apparatus receiving the multiplicity of selectable waveforms for creating therefrom desired sound signals also comprises digital to analog conversion apparatus.

In accordance with a preferred embodiment of the invention, the apparatus for cataloging the output of a noise generator to provide a multiplicity of waveforms and the apparatus receiving the multiplicity of waveforms for creating therefrom desired sound signals are operative in response to control signals received from a computer, such as instructions to start, pause, resume and volume control signals.

In accordance with a preferred embodiment of the invention, the computer comprises a personal computer.

In accordance with a preferred embodiment of the invention, the computer operates on the basis of sound program instructions contained on a portable storage medium.

Further in accordance with a preferred embodiment of the invention, the computer is operative to permit operator control of the sound volume via a conventional computer control interface, such as a keyboard, joy-stick or a mouse.

Further in accordance with a preferred embodiment of the invention, the portable storage medium also includes video data corresponding to the sound program instructions.

Additionally in accordance with a preferred embodiment of the invention, the portable storage medium comprises an audio/visual amusement package.

Further in accordance with a preferred embodiment of the invention, the sound program instructions appear on the portable storage medium in compressed format.

The apparatus of the present invention may be incorporated inside the housing of a personal computer, as an additional card, or alternatively may be external thereto and communicate therewith via conventional data ports.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
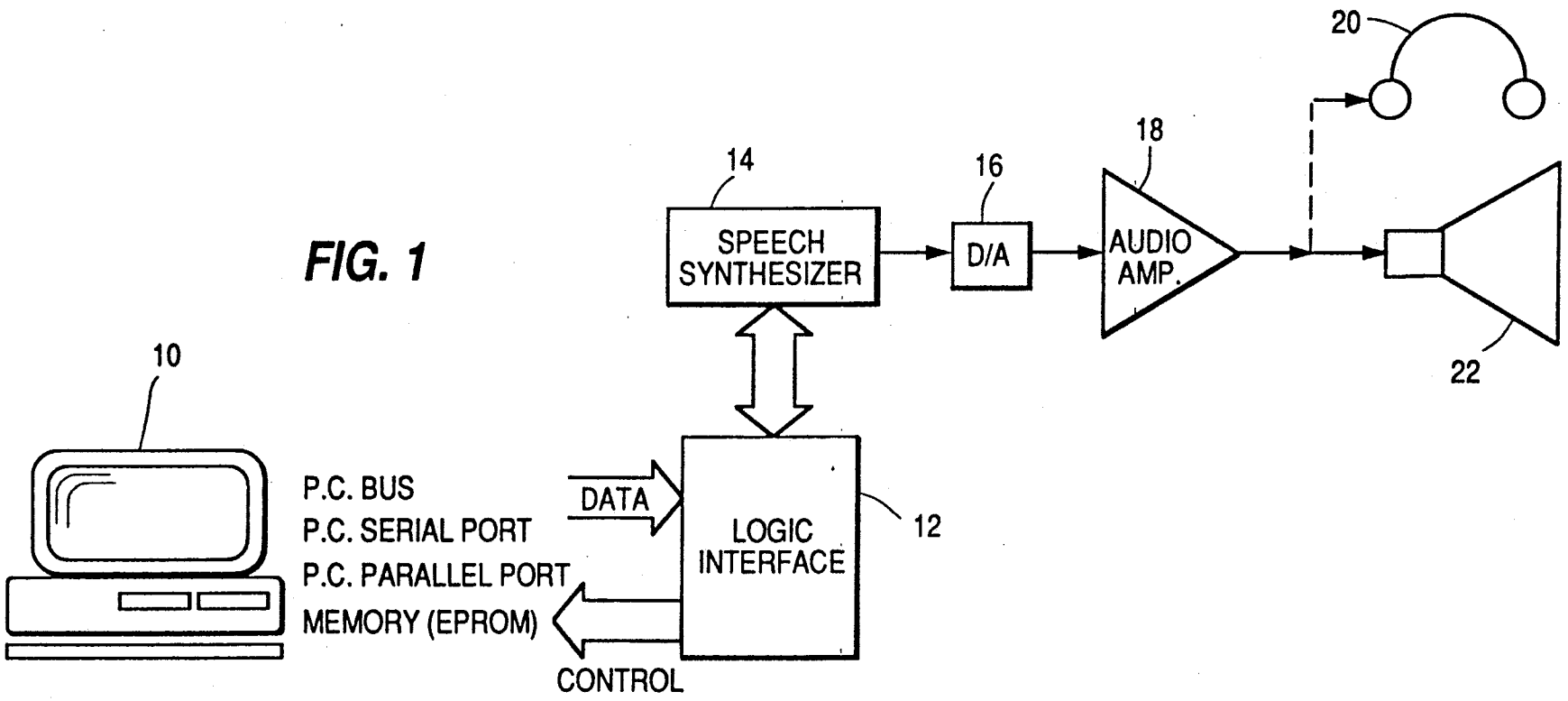
FIG. 1 is a generalized block diagram illustration of a sound generation system constructed and operative in accordance with a preferred embodiment of the present invention.

Reference is now made to FIG. 1, which illustrates a sound generation system constructed and operative in accordance with a preferred embodiment of the present invention. The speech synthesizer preferably comprises or works with a personal computer 10, such as an IBM PC, which is coupled via a suitable bus, or via serial or parallel ports to logic interface circuitry 12. Alternatively, the interface circuitry 12 may operate in conjunction with and read from a separate memory, such as an EPROM.

Circuitry 12 is typically based on a Texas Instruments TIBPAL 20L8-25, which is preferably programmed as indicated in the listing attached hereto as Annex A. Circuitry 12 provides suitable interfacing between the personal computer 10 and a speech synthesizer 14.

The speech synthesizer 14 preferably is based on a TMS320C17 chip from Texas Instruments and will be described in detail hereinbelow with reference to FIG. 2.

The output of the speech synthesizer 14 is supplied via a digital to analog converter 16 and via an audio amplifier 18 to a sound output device, such as headphones 20 or a speaker 22.

Figure 2:
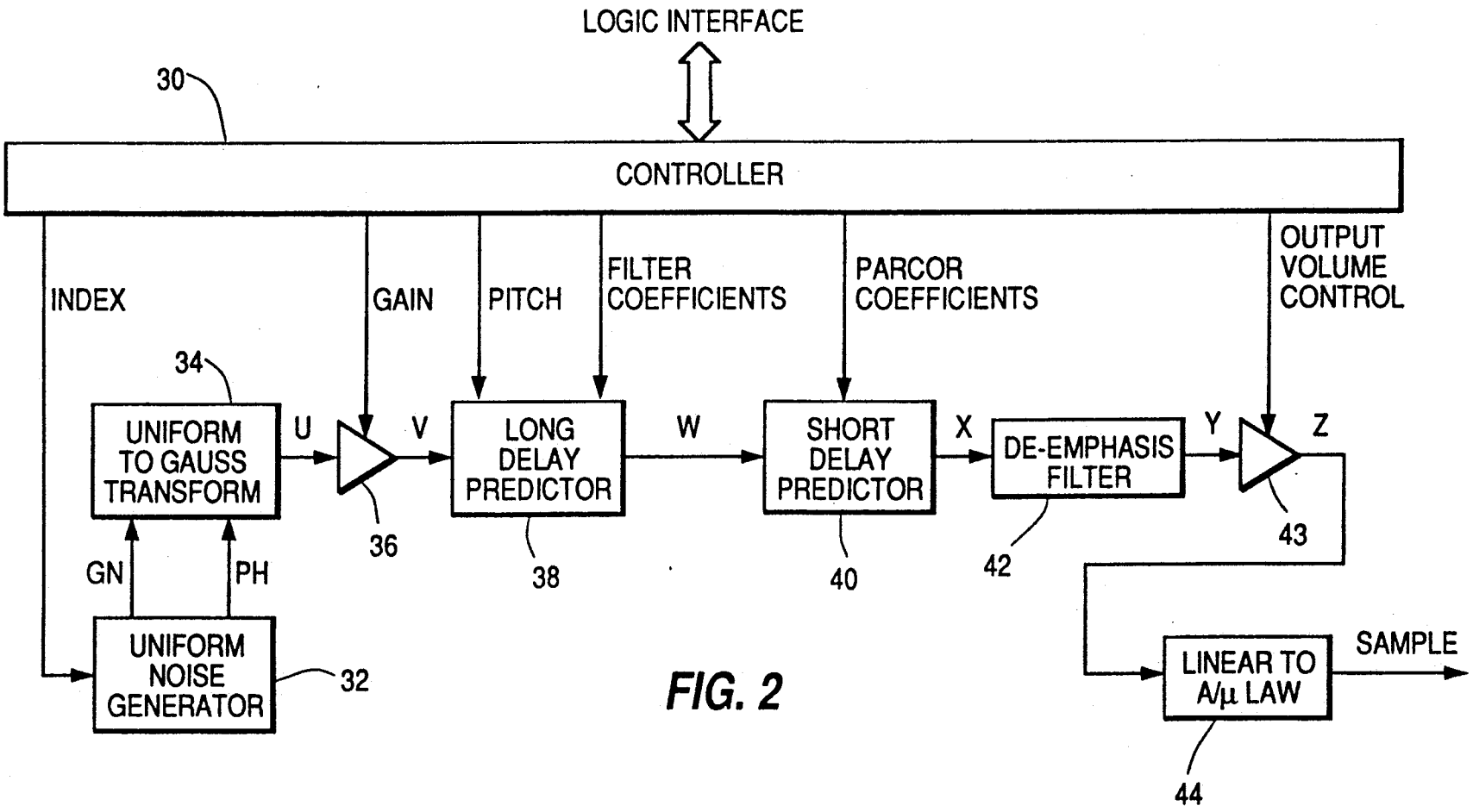
FIG. 2 is a generalized block diagram illustration of a speech synthesizer constructed and operative in accordance with a preferred embodiment of the invention and forming part of the system of FIG. 1.

Reference is now made to FIG. 2, which illustrates, in generalized block diagram form, a speech synthesizer constructed and operative in accordance with a preferred embodiment of the present invention. The speech synthesizer preferably comprises a controller 30, which, on the basis of compressed sound information typically supplied to the PC on a diskette, which may be associated, for example, with a video game, provides index inputs to a noise generator 32. Noise generator 32 is essentially a number generator operative to provide a pair of series of number outputs preferably generally uniformly distributed between 0 and 1, in response to the index inputs.

According to a preferred embodiment of the present invention, the pair of series of number outputs is supplied to a uniform to gaussian transform operator 34, which converts the series of number outputs to waveforms having generally Gaussian characteristics. It is noted that the difference between the waveforms produced by noise generator 32 and by gaussian transform operator 34 is not readily discernible to the human eye, unaided.

The output of transform operator 34 is supplied to a variable gain amplifier 36, which operates in response to gain control signals received from controller 30 and provides an output to a long delay predictor 38. Long delay predictor 38 is operative to correlate sound patterns over multiple samples in response to pitch signals and filter coefficients received from controller 30. The output of long delay predictor 38 is supplied to a short delay predictor 40, which typically comprises a lattice filter which is operative to correlate sound patterns within given samples in response to PARCOR coefficients received from controller 30.

The output of short delay predictor 40 may be typically supplied via a de-emphasis filter 42 and an output amplifier 43, which receives an output volume control signal from controller 30 and provides an output to a linear to A or Mu Law converter 44, which is operative to adapt the output signal to a Codec digital to analog converter.

In accordance with a preferred embodiment of the invention, the circuitry of FIG. 2 is embodied by means of suitable software in a TMS320C17 chip from Texas Instruments.

Figure 3B:
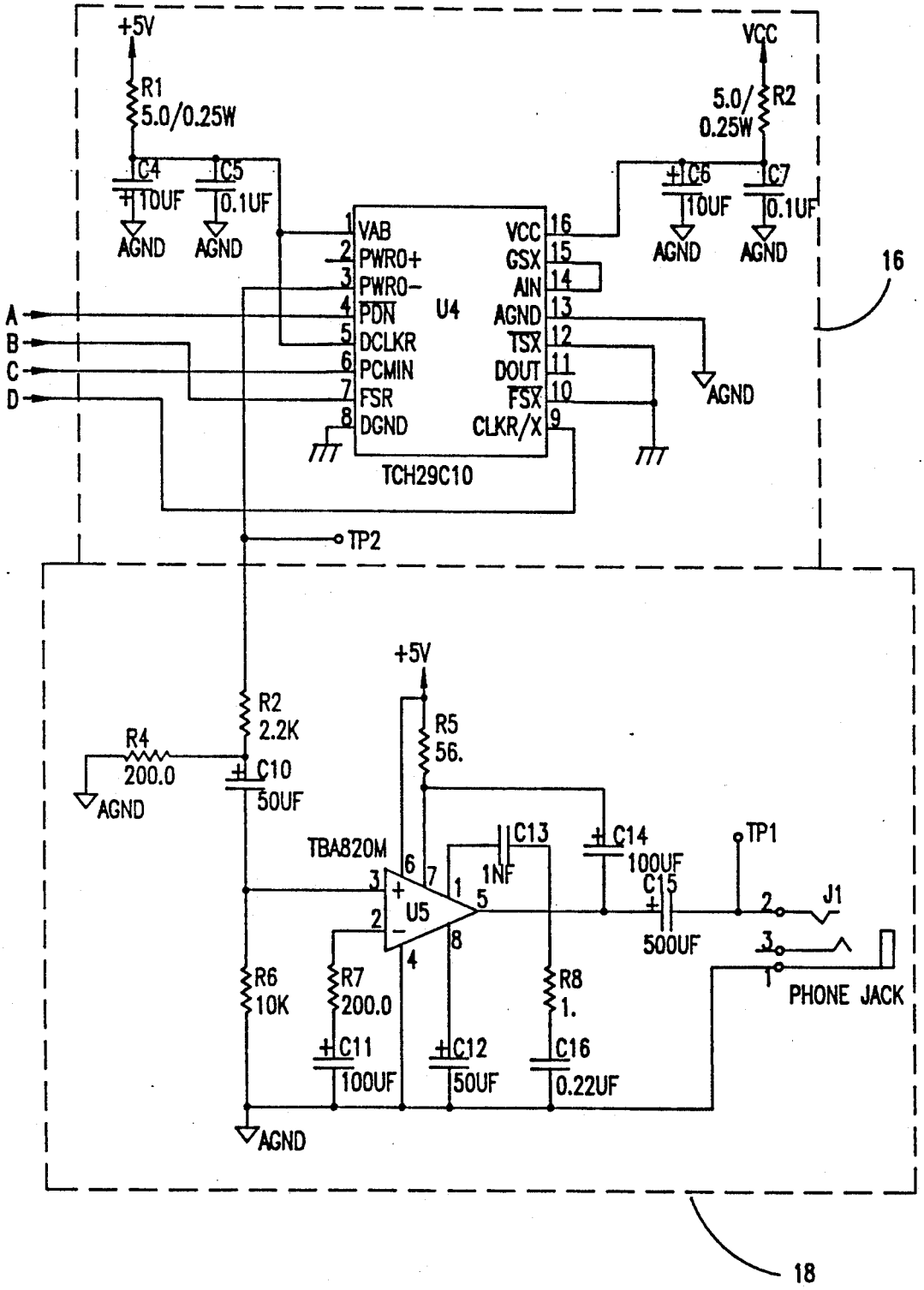
FIGS. 3A/1, 3A/2 and 3B are together a schematic illustration of the apparatus of FIG. 1 excluding the personal computer and audio output device.

A detailed schematic illustration of the circuitry of FIG. 1 is presented in FIGS. 3A/1, 3A/2 and 3B. Blocks bearing the reference numerals of the elements in FIG. 1, illustrate those portions of the circuitry of FIGS. 3A/1, 3A/2 and 3B corresponding thereto.

Detailed flowcharts which describe the operation of software which enables the circuit functions of FIG. 2 to be carried out by the TMS320C17 chip are provided in Annex B. A brief summary of the operation of the software appears hereinbelow:

Initially the output of the gaussian transform operator 34 downstream of amplifier 36 is organized into frames of typical length 2 msec (16 samples at 8 KHz).

For each frame, the uniform noise generator 32 receives from the controller 30 an index and the amplifier 36 receives from the controller 30 a gain control signal.

The long delay predictor 38 receives from the controller 30, predictor parameters, such as pitch and filter coefficients, every fourth frame.

The short delay predictor 40 receives from the controller 30, predictor parameters, such as PARCOR coefficients, every eighth frame. The PARCOR coefficients are coded in such a way as to be compatible with the U.S. Government Standard LPC-10 Algorithm. This algorithm is described in detail in an article by T. E. Tremain, entitled "The Government Standard Linear Predictive Coding Algorithm: LPC-10, Speech Technology, April, 1982, pp. 40 –49, which is hereby incorporated by reference.

The various inputs to elements 32–40 are supplied by the controller 30 in appropriate synchronization.

In order to enable better understanding of the flowcharts of Annex B, the following general explanation is provided:

The apparatus of FIG. 2, and in particular the elements 32–42, produces three types of signals as follows:

Type I, wherein full operation of noise generator 32, transform operator 34, and predictors 38 and 40 occurs, in response to provision of a full 10 bit index and 6 bit gain control signal by controller 30 to generator 32 and amplifier 36 respectively. Where speech is present, voiced speech will be normally classified as Type I.

Type II, similar to Type I but wherein only an 8 bit index is provided to generator 32 and wherein the pitch and filter coefficients supplied to the long delay predictor are zero. For Type II signals only part of the PARCOR coefficients are supplied to the short delay predictor 40. Where speech is present, unvoiced speech will be normally classified as Type II.

Type III, silence wherein gain control signal produces near-zero gain at amplifier 36 and the inputs from controller 30 to predictors 38 and 40 are zero.

Referring now to flowchart B-1, there is shown a flowchart illustrating a main routine, which refers to subroutines for Types I, II and III, which appear in flowcharts B-2, B-3, and B-4 respectively. A flowchart B-5 illustrates a subroutine employed in the subroutines of flowcharts B-2, B-3 and B-4 which produce the output samples from the system. References made in the flowcharts to time varying variables GN, PH, U, V, W . . . refer to the various outputs bearing such indications in FIG. 2.

The operation of the system described above is extremely efficient in terms of utilization of the computing power of the personal computer. For example, computer 10 is an IBM PC based on an Intel 8088 operating at 4.77 MHz. The system requires no more than about 20% of the real time computing power of the computer 10, thus enabling background processing of speech while providing main processing of other data, such as graphics.

It will be appreciated by persons skilled in the art that the present invention is not limited by what has been particularly shown and described hereinabove. Rather the scope of the present invention is defined only by the claims which follow:

I claim:

1. A speech synthesizer comprising:

a controllable noise generator having an output;

means for controlling said noise generator for cataloging its output to provide a multiplicity of predetermined waveforms; and means for receiving the multiplicity of waveforms and creating therefrom desired sound signals.

2. Apparatus according to claim 1 and also comprising an operator input device which is operative to provide operator control of volume of the desired sound signals.

3. Apparatus according to claim 1 and wherein said means for controlling comprises means for selectably providing predetermined waveform outputs in response to predetermined index inputs.

4. Apparatus according to claim 3 and wherein said means for selectably providing comprises means for selectably providing a multiplicity of generally gaussian waveform outputs in response to said predetermined index inputs.

5. Apparatus according to claim 1 and wherein said means for controlling and said means for creating therefrom desired sound signals are operative in response to control signals received from a computer.

6. Apparatus according to claim 5 and wherein said computer comprises a personal computer.

7. Apparatus according to claim 5 and wherein said computer operates on the basis of sound program instructions contained on a portable storage medium.

8. Apparatus according to claim 7 and wherein said portable storage medium also includes video data corresponding to the sound program instructions.

9. Apparatus according to claim 8 and wherein said portable storage medium comprises an audio/visual package.

10. Apparatus according to claim 8 and wherein said sound program instructions appear on the portable storage medium in compressed format.

11. Apparatus according to claim 5 and wherein said computer includes means for permitting operator control of sound volume.

12. Apparatus according to claim 1 and wherein said means for controlling comprises a long delay prediction filter and a short delay prediction filter.

13. Apparatus according to claim 12 and wherein said means for creating also comprises variable gain means.

14. Apparatus according to claim 12 and wherein said long delay prediction filter is operative to emphasize periodic signal characteristics having a characteristic periodicity of at least 16 sound samples taken at an 8 KHz sampling rate.

15. Apparatus according to claim 12 and wherein said short delay prediction filter is operative to emphasize periodic signal characteristics having a characteristic periodicity of less than 12 sound samples taken at an 8 KHz sampling rate.

16. Apparatus according to claim 12 and wherein said long delay prediction filter is operative upstream of said short delay prediction filter.

17. A personal computer sound synthesizer comprising:

a memory, forming part of a personal computer, for storing a plurality of index inputs;

a codebook including a multiplicity of waveforms;

means for receiving the multiplicity of waveforms and creating therefrom desired sound signals in response to said index inputs received in real time from said memory.

18. Apparatus according to claim 17 and wherein said means for creating comprises means for selectably providing predetermined waveform outputs in response to predetermined index inputs.

19. Apparatus according to claim 18 and wherein said means for selectably providing comprises means for selectably providing a multiplicity of generally gaussian waveform outputs in response to said predetermined index inputs.

20. Apparatus according to claim 17 and wherein said means for creating comprises a long delay prediction filter and a short delay prediction filter.

21. Apparatus according to claim 20 and wherein said means for creating also comprises variable gain means.

22. Apparatus according to claim 20 and wherein said long delay prediction filter is operative to emphasize periodic signal characteristics having a characteristic periodicity of at least 16 sound samples taken at an 8 KHz sampling rate.

23. Apparatus according to claim 20 and wherein said short delay prediction filter is operative to emphasize periodic signal characteristics having a characteristic periodicity of less than 12 sound samples taken at an 8 KHz sampling rate.

24. Apparatus according to claim 20 and wherein said long delay prediction filter is operative upstream of said short delay prediction filter.

25. Apparatus according to claim 17 and wherein said means for creating also comprises digital to analog conversion means.

26. Apparatus according to claim 17 and wherein said computer includes means for permitting operator control of sound volume.

27. Apparatus according to claim 17 and wherein said means for creating desired sound signals are operative in response to control signals received from a computer.

28. Apparatus according to claim 17 and wherein said computer operates on the basis of sound program instructions contained on a portable storage medium.

29. Apparatus according to claim 28 and wherein said portable storage medium also includes video data corresponding to the sound program instructions.

30. Apparatus according to claim 28 and wherein said portable storage medium comprises and audio/visual package.

31. Apparatus according to claim 28 and wherein said sound program instructions appear on the portable storage medium in compressed format.

32. Apparatus according to claim 17 and also comprising an operator input device, forming part of the personal computer, for permitting operator control of the speech synthesis.

* * * * *